United States Patent [19]

Yoshihara et al.

[11] 4,182,647

[45] Jan. 8, 1980

[54] PROCESS OF PRODUCING STRIPE FILTER

[75] Inventors: Satoshi Yoshihara, Kawasaki; Nobuyuki Sekimura, Yokohama, both of Japan

[73] Assignee: Canon Kabushiki Kaisha, Tokyo, Japan

[21] Appl. No.: 877,687

[22] Filed: Feb. 14, 1978

[30] Foreign Application Priority Data

Feb. 21, 1977 [JP] Japan ..... 52-17898

[51] Int. Cl.[2] ..... C23F 1/02

[52] U.S. Cl. ..... 430/314; 430/23; 156/659.1; 156/656; 427/166

[58] Field of Search ..... 427/54, 64, 68, 164–166, 427/264; 96/36, 36.1, 38.3; 156/652, 656, 650, 651, 655, 659, 661; 350/164, 311; 313/374

[56] References Cited

U.S. PATENT DOCUMENTS

| | | | |
|---|---|---|---|
| 2,992,919 | 7/1961 | Beeler et al. | 96/36.1 |
| 3,015,688 | 1/1962 | Ridgeway | 96/38.3 UX |
| 3,839,039 | 10/1974 | Suzuki et al. | 96/38.3 |
| 3,914,464 | 10/1975 | Thomasson et al. | 427/54 |

FOREIGN PATENT DOCUMENTS

| | | |
|---|---|---|
| 46-1448 | 1/1971 | Japan . |
| 47-37236 | 11/1972 | Japan . |

*Primary Examiner*—William A. Powell

*Attorney, Agent, or Firm*—Fitzpatrick, Cella, Harper & Scinto

[57] ABSTRACT

A process of producing a parallel type of stripe filter comprises the steps of:

(a) forming a metal layer (I) on a transparent base plate into a striped configuration.

(b) forming thereon a dichroic layer having predetermined spectral characteristics, (c) further forming a metal layer (II) on said dichroic layer, the etching solution for said metal layer (II) being different from that for the metal layer (I), (d) utilizing the metal layer (II) as the protecting layer for the dichroic layer when another dichroic layer is formed subsequently, and (e) finally removing the metal layer (II) to expose the dichroic layers overlying the transparent base plate into a striped configuration.

3 Claims, 74 Drawing Figures

PROCESS OF PRODUCING STRIPE FILTER

BACKGROUND OF THE INVENTION

1. Field of the Invention

The present invention relates to a process of producing a parallel type of stripe filter which is used for a color television camera and the like when a color television signal is to be obtained by using an image pickup tube.

2. Description of the Prior Art

A target plate is incorporated into an image pickup tube used for a handy color camera and the like which obtains a color signal by using a single image pickup tube. Such target plate is that prepared by processing a filter material into a striped configuration in order to extract three color signals.

In the target plate incorporated into an image pickup tube used in the phase separation system, two-three kinds of stripe filters are aligned at the edge and arranged in parallel for the purpose of extracting two or three color signals. The accuracy in the alignment of these stripe filters directly affects the obtained image, and therefore, it is required to increase the accuracy in the alignment. It is a serious problem in the art how such accuracy in the alignment at the edge of the stripe filters is increased.

A process hitherto used for producing a stripe filter for extracting three color signals comprises preparing separately three kinds of stripe filters for extracting different three color signals in such a manner that a filter material is vapor-deposited onto a glass base plate and then it is mechanically cut into a striped configuration, and aligning the separately prepared three stripe filters at the edge and further super-imposing them on one another.

In alternative process so far employed for producing a stripe filter for extracting three color signals, three kinds of stripe filters are separately prepared in such a manner that a groove is formed on a glass base plate in a striped configuration and the striped groove is filled up with a filter material, and then the three stripe filters thus separately made are aligned at the edge and superimposed on one another.

Further, another process of producing a stripe filter is proposed and disclosed in Japanese Laid Open No. 37236/1972. Each step of this process is similar to that shown in FIGS. 1A through 1F which will be again referred to later. Such process will be explained with reference to those figures.

As shown in FIG. 1A, onto a glass base plate 1 is vapor-deposited a metal capable of being easily etched, for example copper, to form a metal layer 2, and then a photoresist 4 is coated uniformly on the metal layer 2 as illustrated in FIG. 1B. A stripe photomask 3 having a predetermined pitch as shown in FIG. 2 is brought into close contact with the photoresist 4 thus coated. The photoresist 4 is exposed to a light 5 for the photoresist sensitization through the photomask 3, and then the development is carried out to remove the photoresist in the exposed area. Further, the metal which is not covered by the photoresist is dissolved and removed by an etching solution. This phase is shown in FIG. 1C. The remaining photoresist 4 is also removed so that the metal layer 2 is exposed in a striped form as shown in FIG. 1D. Onto the glass base plate having thereon such striped metal layer is vapor-deposited a filter material in several layers as illustrated in FIG. 1E. Thereafter, etching is made with respect to the metal layer 2 by using the same etching solution as mentioned above so that the filter material overlying the striped metal layer is removed while the metal layer is dissolved and removed. As the result, the desired stripe filter shown in FIG. 1F is obtained.

In the above mentioned process, three kinds of stripe filters are prepared separately. These stripe filters are aligned at the edge and superimposed one another to produce a stripe filter for extracting three color signals.

The foregoing processes of producing a stripe filter require the alignment, at the edge, of each stripe filter constituting the final stripe filter, which is very difficult to do so with high accuracy.

The applicants have attempted the processes shown in FIGS. 1A–1L and FIGS. 3A–3P for the purpose of producing a stripe filter for extracting different three color signals on a single base plate.

FIGS. 1A–1L show a series of steps for producing a parallel type of stripe filter for extracting two color signals in which two color filter elements, for example those for cyan and yellow are alternatively arranged in parallel to each other on a single base plate. In the steps indicated in FIGS. 1A–1F, a metal capable of being etched, for example aluminum and copper, is vapor-deposited onto a transparent base plate 1, for example made of glass, plastics or the like as shown in FIG. 1A so that a metal layer 2 is formed. A photoresist 4 is then coated on the metal layer as shown in FIG. 1B. On the other hand, a photomask 3 is prepared with high accuracy which has a transparent portion and non-transparent portion, both being alternatively arranged in a striped form at suitable intervals as illustrated in FIG. 2. As shown in FIG. 1B, the photomask 3 is positioned over the photoresist 4 in non-contact state, in contact with the photoresist layer 4 by using an optical printing device. Such photoresist is exposed to a light from a light source for the photoresist sensitization through the photomask 3 and the developing treatment is effected to remove the photoresist 4 in the exposed area. Then, the metal layer 2 which is not covered by the photoresist is etched and dissolved with an etching solution to remove the metal layer as indicated in FIG. 1C. The remaining photoresist 4 in the unexposed area is also removed. This phase is illustrated in FIG. 1D. In the above mentioned manner, there is prepared a plate in which the metal layers 2 are arranged on the transparent base plate 1 in a striped configuration at suitable intervals.

Subsequently, as indicated in FIG. 1E, a dichroic layer 6 (for example cyan) composed of multiple layer film having the pre-determined spectral characteristics is uniformly formed on the transparent base plate 1 and the metal layer 2 by the vapor-depositing method. The metal layer 2 is then removed along with the overlying dichroic layer 6 so that only the dichroic layer 6 on the base plate 1 remains which is arranged in a striped configuration as shown in FIG. 1F.

For the purpose of forming another dichroic layer (for example yellow) having different spectral characteristics, a series of steps described above may be repeated as shown in FIGS. 1G–1L. As shown in FIG. 1G, a metal layer 2 is formed by the vapor-deposition on the transparent base plate 1 having thereon the striped dichroic layer 6, and a photoresist 4 is then coated as indicated in FIG. 1H. Exposure of the photoresist 4 to a light is carried out through the photomask 3 and the development is also effected to remove the photoresist 4 in the exposed area, and thereafter the metal layer 2 in the exposed area is dissolved and removed. This phase is shown in FIG. 1I. Further, the remaining photoresist 4 is also removed so that a plate is obtained which has thereon the dichroic layer 6 and metal layer 2. The latter layer 2 is superimposed on the former layer 6, and the superimposed portion is arranged in a striped configuration as illustrated in FIG. 1J. A dichroic layer 7 (for example yellow) having the pre-determined spectral characteristics is uniformly formed on both the base plate 1 and metal layer 2 by vapor-deposition as illustrated in FIG. 1K. Lastly, the metal layer 2 is removed together with the overlying dichroic layer 7 so that only the dichroic layers 6 and 7 remain which are alternatively arranged on the transparent base plate 1 in a striped configuration as shown in FIG. 1L.

FIGS. 3A–3P show the process of producing a parallel type of stripe filter for extracting three color signals which has been attempted by the applicants. In this process, three color filter elements, that is, cyan, yellow and magenta are successively arranged in parallel to one another. A series of steps in this process is similar to that in producing a parallel type of stripe filter for extracting two kinds of color signals. Therefore, the procedure in the steps of FIGS. 1A–1F is repeated in the steps of FIGS. 3A–3F, FIGS. 3G–3K and FIGS. 3L–3P so that a stripe filter for extracting three color signals is obtained. Such a stripe filter is as shown in FIG. 3P. In addition, reference numeral 8 in FIGS. 3O and 3P denotes a dichroic layer (for example magenta) having the pre-determined spectral characteristics.

However, various disadvantages or defects are pointed out in the processes of producing a stripe filter as described above. In particular, the disadvantages reside in the steps shown in FIGS. 1H and 1I, FIGS. 3H and 3I, and FIGS. 3M and 3N. That is, it is considerably difficult to effect the exposure and development to the photoresist layer 4 so that the line width of such layer may be always constant. Also, when the metal layer is etched, considerable difficulty is found in bring at least one side of the remaining metal layer 2 (in FIGS. 1I, 3I and 3N) in line with one side of the underlying dichroic layer 6. Therefore, it is difficult to finish accuracy the stripe filter to the desired form as shown in FIGS. 1L and 3P. In fact, the finally processed state of the stripe filter actually produced by the process is as illustrated in FIGS. 4 and 5 which are concerned with two-color and three-color stripe filters for extracting two color signals and three color signals, respectively. Various causes for such a state of the stripe filter are considered, for example, an accidental error of the line width of the layers due to the unsuitable position of the photomask 3, change in the viscosity of the photoresist 4 in each step of using it and unevenness in the thickness of the photoresist layer due to the irregularity in the rotation of a spiner used in coating it, change in the exposure amount due to variation in the voltage of the light source and the like, change in the etching amount per the unit time due to change in the composition and temperature of the etching solution, and others. However, it is very difficult to eliminate completely those changing factors. For the purpose of preventing the overlapping of the dichroic layers and eliminating the clearance between them, it is required to employ for higher level of the technique for the production of the parallel type of stripe filter, which is very difficult.

SUMMARY OF THE INVENTION

It is therefore an object of the present invention to provide a process of producing a parallel type of stripe filter which is free of the above mentioned disadvantages or defects.

It is another object of the present invention to provide a process of producing a parallel type of stripe filter for extracting two-three color signals in which a series of the steps can be shortened, and it is not necessary to align accurately the boundary line of the adjacent dichroic layers, i.e. filter layers when the photoresist is exposed to light, and further a stripe filter of high accuracy can be obtained which has not been attained by the prior art process.

In accordance with the present invention, there is provided a process of producing a parallel type of stripe filter which comprises the step of:

(a) forming a metal layer (I) on a transparent base plate into a striped configuration, (b) forming thereon a dichroic layer having predetermined spectral characteristics, (c) further forming a metal layer (II) on said dichroic layer, the etching solution for said metal layer (II) being different from that for the metal layer (I), (d) utilizing the metal layer (II) as the protecting layer for the dichroic layer when another dichroic layer is formed subsequently, and (e) finally removing the metal layer (II) to expose the dichroic layers overlying the transparent base plate into a striped configuration.

DESCRIPTION OF THE PREFERRED EMBODIMENTS

The present invention will be explained concretely with reference to FIGS. 6A–6I, 7A–7O and 8A–8M.

Referring first to FIGS. 6A–6I, a series of steps illustrated in FIGS. 6A–6E is the same as that in FIGS. 1A–1E which have been explained in the foregoing. Repetition of the explanation for FIGS. 6A–6E is omitted here.

Figure 1A:
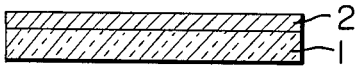
FIGS. 1A–1L are explanatory illustrations of a process of producing a parallel type of stripe filter for extracting two color signals which has been attempted by the applicants in accordance with the conventional process.
Figure 1B:
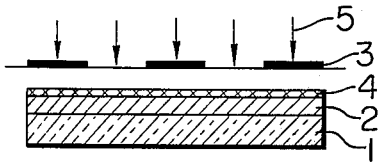
Figure 1C:
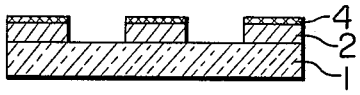
Figure 1D:
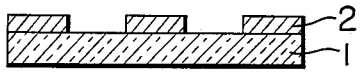
Figure 1E:
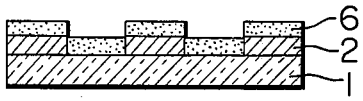
Figure 1F:
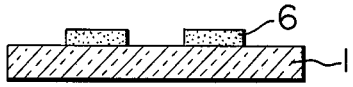
Figure 1G:
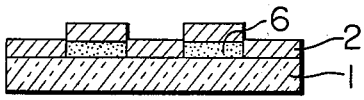
Figure 1H:
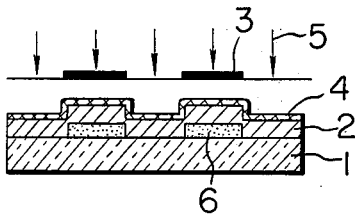
Figure 1I:
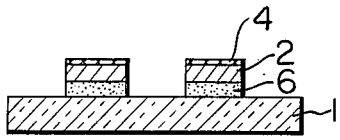
Figure 1J:
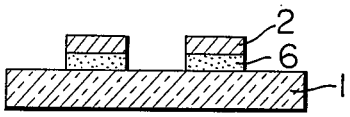
Figure 1K:
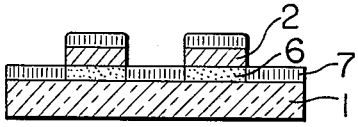
Figure 1L:
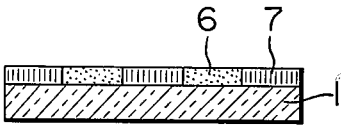
Figure 2:
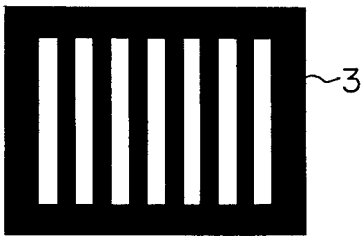
FIG. 2 is an illustration of an example of a photomask.
Figure 3A:
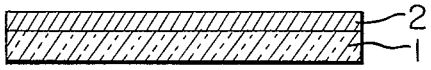
FIGS. 3A–3P are explanatory illustrations of a process of producing a parallel type of stripe filter for extracting three color signals which has been attempted by the applicants in accordance with the conventional process.
Figure 3B:
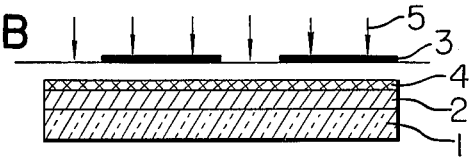
Figure 3C:
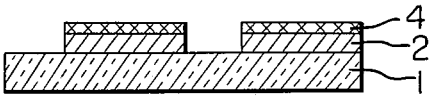
Figure 3D:
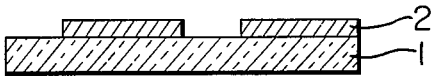
Figure 3E:
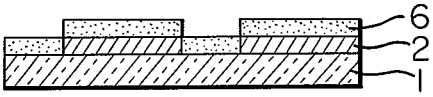
Figure 3F:
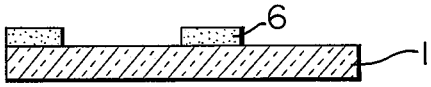
Figure 3G:
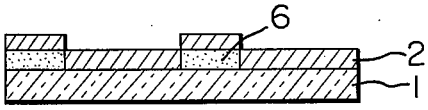
Figure 3H:
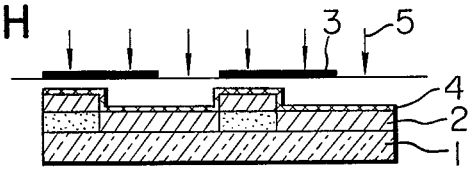
Figure 3I:
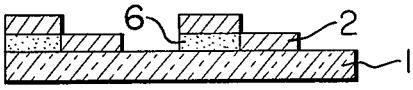
Figure 3J:
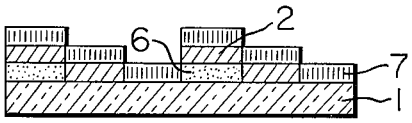
Figure 3K:
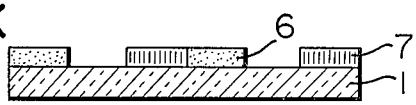
Figure 3L:
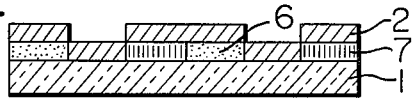
Figure 3M:
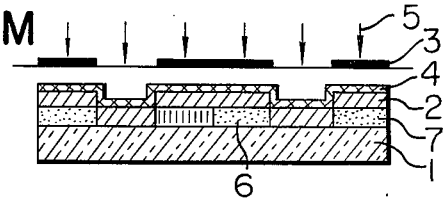
Figure 3N:
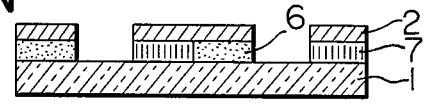
Figure 3O:
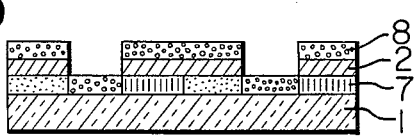
Figure 3P:
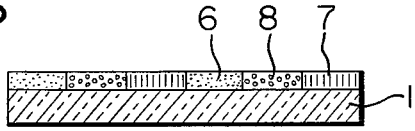
Figure 4A:
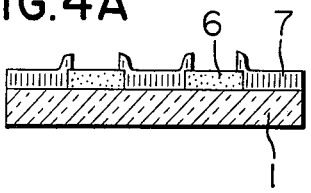
FIGS. 4A–4C and 5A–5D are sectional views of one example of each defective stripe filter produced by the processes illustrated in FIGS. 1A–1L and FIGS. 3A–3P.
Figure 4B:
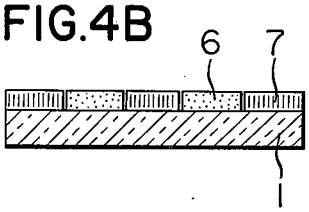
Figure 4C:
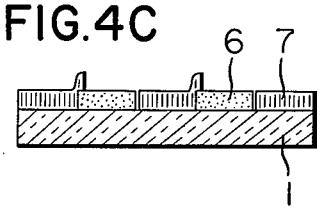
Figure 5A:
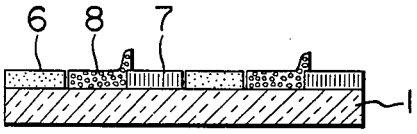
Figure 5B:
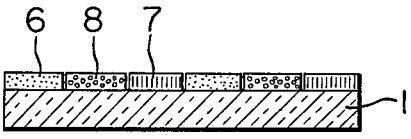
Figure 5C:
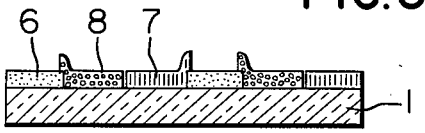
Figure 5D:
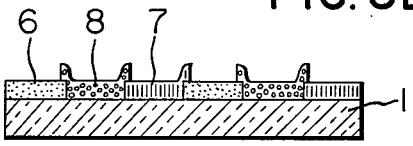
Figure 6A:
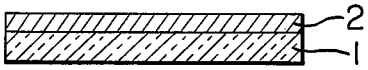
FIGS. 6A–6I are explanatory illustrations of the steps in a process of producing a parallel type of stripe filter for extracting two color signals in accordance with the present invention.
Figure 6B:
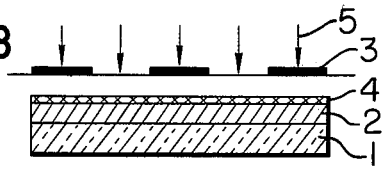
Figure 6C:
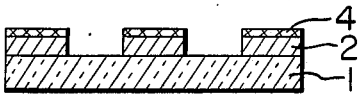
Figure 6D:
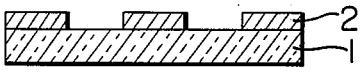
Figure 6E:
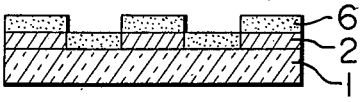
Figure 6F:
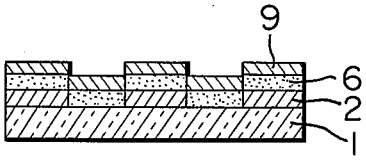
Figure 6G:
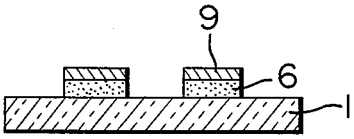

After the completion of the step shown in FIG. 6E, aother metal capable of being etched, such as chromium and the like is vapor-deposited on the dichroic layer 6 without removal of the metal layer 2 previously formed, to form another metal layer 9 as illustrated in FIG. 6F. The metal layer 9 is capable of being etched similarly to the metal layer 2, but the etching solution for etching the metal layer 9 is different from that for the metal layer 2. At the next step, the metal layer 2 is removed together with the overlying dichroic layer 6 and metal layer 9 to obtain a structure having a lamination, i.e. layered portion of the dichroic layer 6 and the metal layer 9 on the transparent base plate 1 as shown in FIG. 6G. The lamination is arranged in a striped configuration, and the dichroic layer and the metal layer are perfectly aligned at the edge.

Figure 6H:
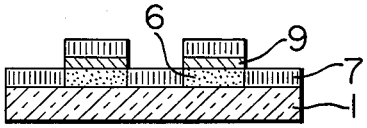
Figure 6I:
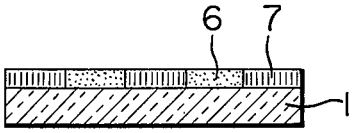

As illustrated in FIG. 6H, dichroic layer 7 is uniformly formed on the structure obtained in the step of FIG. 6G by vapor-deposition procedure. The metal layer 9 is then removed together with the overlying dichroic layer 7 so that the dichroic layers 6 and 7 remain on the transparent base plate. Both layers 6 and 7 are alternatively arranged in a striped configuration as illustrated in FIG. 6I.

In the process according to the present invention as described above, the metal layer 9 is vapor-deposited on the dichroic layer 6 provided that the etching solution for the metal layer 9 is different from that for the metal layer 2 as shown in FIG. 6F, and thereafter, the metal layer 2 is removed. Then, the dichroic layer 7 is vapor-deposited, and the metal layer 9 is removed together with the overlying dichroic layer 7. These simple steps in the present invention can eliminate serious disadvantages or defects found in a series of the steps illustrated in FIGS. 1A–1L. In accordance with the present invention, it is not necessary to set the photomask twice as in a series of steps shown in FIGS. 1A–1L, and it is not required to apply a very accurate etching technique. The present invention do produce a parallel type of stripe filter, with high accuracy, in which the dichroic layers 6 and 7 are alternatively arranged in a striped configuration so that these layers may be accuracy close to each other, in other words, they do not overlap in a portion and do not separate.

Figure 7A:
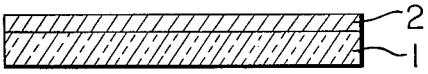
FIGS. 7A–7O and FIGS. 8A–8M are explanatory illustrations of the steps in a process of producing a parallel type of stripe filter for extracting three color signals in accordance with the present invention.
Figure 7B:
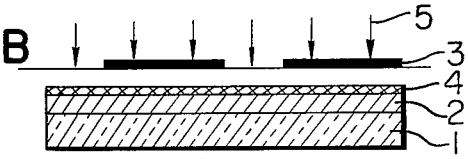
Figure 7C:
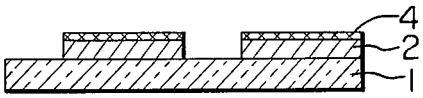
Figure 7D:
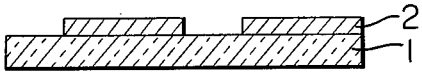
Figure 7E:
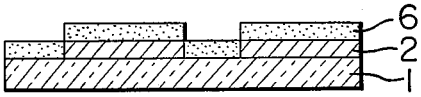
Figure 7F:
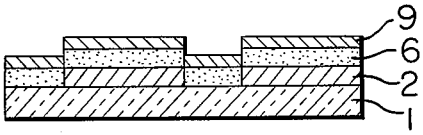
Figure 7G:
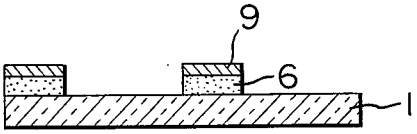

Secondary, the present invention will be explained with reference to FIGS. 7A–7O. A series of the steps illustrated in FIGS. 7A–7G is the same as that in FIGS. 6A–6G except for the stripe pitch of a photomask to be employed. Repetition for the steps of FIGS. 7A–7G is omitted.

Figure 7H:
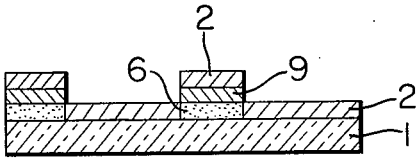
Figure 7I:
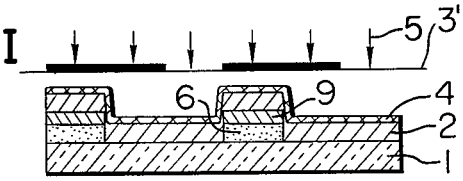
Figure 7J:
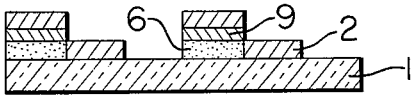
Figure 7K:
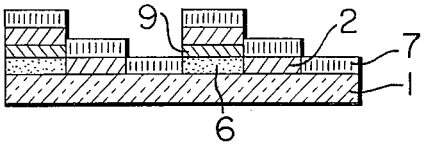
Figure 7L:
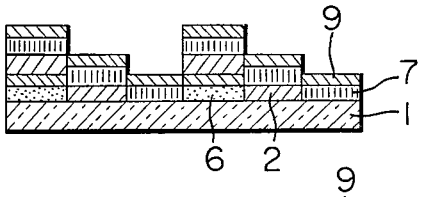
Figure 7M:
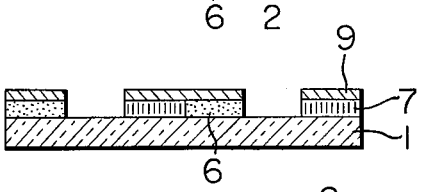
Figure 7N:
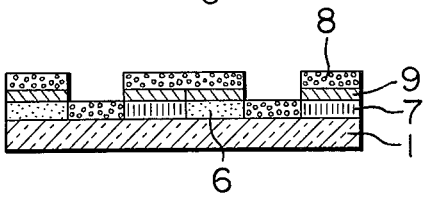

After completion of the step shown in FIG. 7G, a metal is again vapor-deposited on the transparent base plate 1 and metal layer 9 to form a metal layer 2 as shown in FIG. 7H. A photoresist 4 is then coated on the entire top surface as shown in FIG. 7I. The photoresist layer 4 is exposed to a light 5 from a light source for the photoresist sensitization through the photomask 3', and the development is carried out to remove the photoresist in the exposed area. After the development, the metal layer 2 is etched as shown in FIG. 7J. At this time, the alignment of the photomask 3' to the plate, the exposure and development of the photoresist, and the etching of the metal layer should be carried out so that the position of the edge shown by Ⓐ in FIG. 7J' may be within the limitation prescribed in the specifications for the stripe filter. However, the edge of the metal layer 2 indicated by Ⓑ may position anywhere on the metal layer 9 since dichroic layer 6 is protected by the metal layer 9. As shown in FIG. 7K, a dichroic layer 7 (for example yellow) having the pre-determined spectral characteristics is uniformly formed on the structure by vapor-deposition. Further, a metal layer 9, the etching solution for which is different from that for the metal layer 2, is formed by vapor-deposition as indicated in FIG. 7L. The metal of the layer 9 may be different from that of the metal layer formed on the dichroic layer 6, for example it may be tungsten. The metal layer 2 is removed together with the overlying dichroic layer 7 as shown in FIG. 7M, and a dichroic layer 8 (for example magenta) having the pre-determined spectral characteristics is then formed on the structure by vapor-deposition as indicated in FIG. 7N. The metal layer 9 overlying the dichroic layers 6 and 7 is removed together with the dichroic layer 8 formed on the layer 9. As the result, a plate is obtained which has the dichroic layers 6, 7 and 8 being successively arranged in a striped configuration on the transparent base plate 1 as shown in FIG. 70.

Figure 7O:
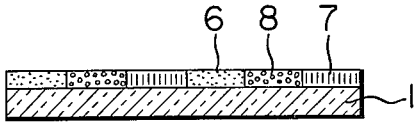
Figure 7J:
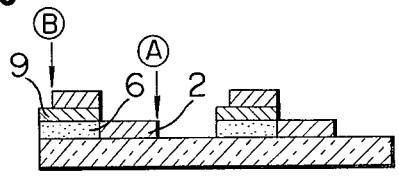

FIG. 8A–8M show a process of producing a parallel type of stripe filter for extracting three color signals in the procedure different from that in the steps shown in FIGS. 7A–7O. This process is carried out in accordance with the present invention.

Figure 8A:
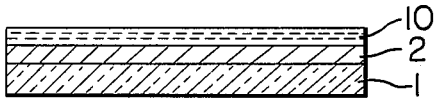

In the step of FIG. 8A, on a transparent base plate 1 such as glass and plastics is vapor-deposited a metal capable of being etched, for example aluminum to form a metal layer 2, and further another metal layer 10, for example copper, is formed by vapor-deposition. The etching solution for the metal layer 10 should be different from that for the metal layer 2.

Figure 8B:
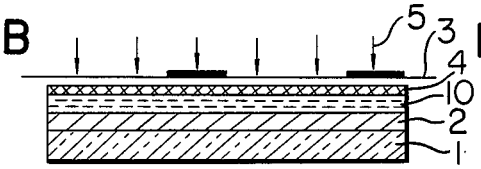
Figure 8C:
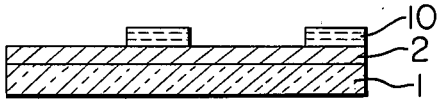

As shown in FIG. 8B, a photoresist 4 is then coated on the metal layer 10, and it is exposed to a light 5 through the photomask 3. Subsequently, the development is carried out to remove the photoresist 4 in the exposed area. Then, the metal layer 10 underlying the removed photoresist is dissolved and removed by an etching solution. Thereafter, a photoresist 4 is coated again on the structure. At this time, it is preferable to remove the photoresist 4 remaining on the metal layer 10, but the photoresist may not be removed.

Figure 8D:
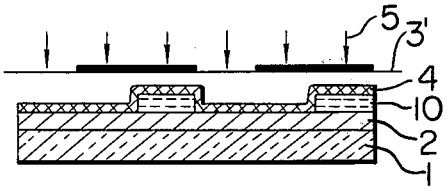
Figure 8E:
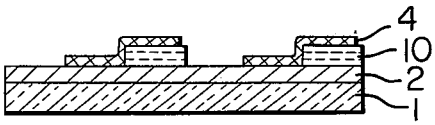
Figure 8F:
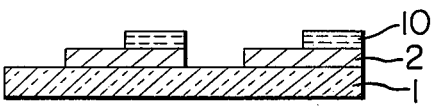
Figure 8G:
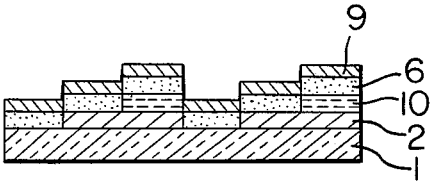
Figure 8H:
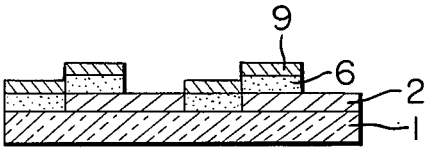
Figure 8I:
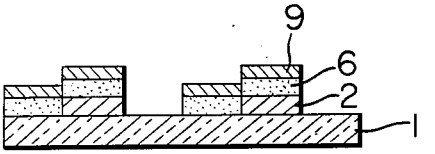
Figure 8J:
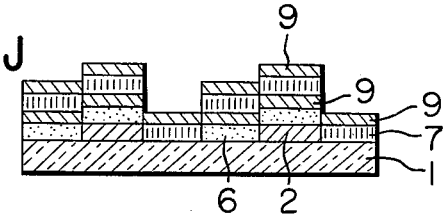
Figure 8K:
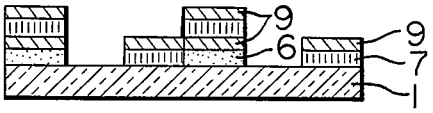
Figure 8L:
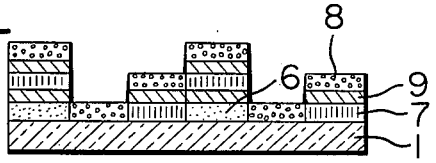
Figure 8M:
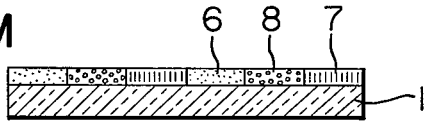

As indicated in FIG. 8D, the structure is exposed to a light 5 over the photomask 3' and the development is effected to obtain the structure as shown in FIG. 8E. The etching is then carried out by an etching solution which etches the metal layer 2 but does not etch the metal layer 10, alternatively by an etching solution which etches both metal layers 2 and 10 to dissolve and remove the area in which the photoresist has been previously removed by the development, as indicated in FIG. 8F. When an etching solution which etches only the metal layer 2 is used, the metal layer 10 and photoresist 4 become protecting layers, and when an etching solution which etches both metal layers 2 and 10 is used, only the photoresist 4 becomes a protecting film. Next, as shown in FIG. 8G, a dichroic layer 6 (for example cyan) having the pre-determined spectral characteristics is uniformly formed on the structure illustrated in FIG. 8F by vapor-deposition, and thereon is vapor-deposited a metal, for example chromium, the etching solution for which is different from that for the metal layers 2 and 10, to form a metal layer 9. The metal layer 10 is then removed together with the overlying dichroic layer 6 and metal layer 9 as shown in FIG. 8H. In the step shown in FIG. 8I, the metal layer 2 is etched while the dichroic layer 6 is a protecting layer, and as shown in FIG. 8J, a dichroic layer 7 (for example yellow)

having the pre-determined spectral characteristics is then formed on the structure by vapor-deposition and further a metal, the etching solution for which is different from that for the metal layer 2, is vapor-deposited to form a metal layer 9. The metal of the metal layer 9 may be different from that of the metal vapor-deposited on the dichroic layer 6, for example it may be tungsten. The metal layer 2 is removed together with the overlying dichroic layers 6 and 7 and metal layer 9 as indicated in FIG. 8K. Thereafter, a dichroic layer 8 (for example magenta) having the pre-determined spectral characteristics is vapor-deposited as shown in FIG. 8L. The metal layer 9 is then removed along with the overlying dichroic layers 7 and 8. As the result, a plate is obtained which has the dichroic layers 6, 7 and 8 which are successively arranged in a striped configuration on the transparent base plate 1 as illustrated in FIG. 8M.

Also in producing a parallel type of stripe filter for extracting three color signals similarly to the case of a stripe filter for two color signals, it is possible to attain accurate alignment of the edges of the adjacent dichroic layers on the base plate by using several kinds of metals, the etching solution for each of which is different from one another, and further, the processing steps can be shortened.

As described in detail, in the process according to the present invention, a single metal layer or several metal layers is formed on a transparent base plate made of glass, plastics or the like in a striped configuration at the pre-determined width intervals, and a dichroic layer composed of a multiple layered film having the pre-determined spectral characteristics is formed on the resulting structure by vapor-deposition. Further, thereon is vapor-deposited a metal, the etching solution for which is different from that for the foregoing metal(s). The metal layer latter formed is used as the protecting layer for the dichroic layer surface. Also, according the processing step, the dichroic layer carrying thereon the latter formed metal layer acts as the mask when the metal layer other than the latter formed metal layer is etched. The above mentioned processing steps are repeated to form the dichroic layers for two-three colors into a striped configuration. The metal layer is ultimately removed by a suitable etching solution to expose the dichroic layer, and as the result, a parallel type of stripe filter is obtained.

In the process of the present invention as described above, it is possible to eliminate the defect or disadvantage that the adjacent dichroic layers overlap at the edges or they are arranged apart from each other, without necessity of applying very accurate etching technique as used in the prior art. Also, the extreme complicate steps in the prior art process can be shortened and made more easy. Therefore, as compared with the conventional process, the present invention produces with high accuracy a parallel type of stripe filter which is excellent in the characteristics and quality, by a simple process.

As the materials used in the process of the present invention, for example the transparent base plate, metal and etching solution, any materials known hithertofore in the art for the same purpose can be utilized, and the etching technique, photoresist technique and vapor-depositing technique conventionally employed in the art can be also applied to the present invention. Therefore, the materials and techniques known and employed in the art may be appropriately selected and used in the present invention so as to satisfy the requirement of the invention.

The vapor-depositing procedure of the dichroic layer having the pre-determined spectral characteristics may be carried out in accordance with the method of the prior art. An optical substance of a higher refractive index, for example $TiO_2$, $ZrO_2$, ZnS and $CeO_2$, and that of a lower refractive index, for example $MgF_2$ and $SiO_2$ may be generally used as the material for the dichroic layer. These optical substances are alternatively vapor-deposited to form thin films so that the thickness of each film may be an old number (m) time of a fourth part of the designed wavelength ($\lambda o$), that is, $(\lambda o/4)\cdot m$. The vapor-deposition of the optical substances is carried out to form multiple layers, for example 7–11 layers so that the thin films may be about one micron in the thickness, and as the result, a dichroic layer is obtained. At that time, the designed wavelength can be suitably selected to form dichroic layers for cyan, yellow and magenta.

What we claim is:

1. A process for producing a parallel type of stripe filter which comprises the steps of:

(a) processing a metal layer (I) formed on the surface of a transparent base plate into predetermined parallel stripes, (b) forming a dichroic layer (I) having pre-determined spectral characteristics on the whole surface of the resulting structure by vapor deposition, (c) forming a metal layer (II) on said dichroic layer (I) by vapor deposition, (d) dissolving said metal layer (I) in the stripe configuration with an etching solution to remove that layer together with the overlying dichroid layer (I) and metal layer (II) deposited thereon, (e) forming a dichroic layer (II) having spectral characteristics different from those of said dichroic layer (I) on the whole surface of the resulting structure by vapor deposition, and (f) dissolving said metal layer (II) with an etching solution to remove that layer together with the dichroic layer (II) deposited thereon, the etching solution used for dissolving said metal layer (II) being different from that used for dissolving said metal layer (I).

2. A process for producing a parallel type of stripe filter which comprises the steps of:

(a) processing a metal layer (I) formed on the surface of a transparent base plate into predetermined parallel stripes, (b) forming a dichroic layer (I) having predetermined spectral characteristics on the whole surface of the resulting structure by vapor deposition, (c) forming a metal layer (II) on said dichroic layer (I) by vapor deposition, (d) dissolving said metal layer (I) in the stripe configuration with an etching solution to remove that layer together with the overlying dichroid layer (I) and metal layer (II) deposited thereon, (e) forming a metal layer (III) on the whole surface of the resulting structure by vapor deposition, (f) forming a photoresist layer on said metal layer (III), and subjecting the resulting structure to exposure, development and etching treatment to remove pre-determined areas in a stripe configuration, of said metal layer (III) directly in contact with said transparent base plate, (g) forming a dichroic layer (II) having spectral characteristic different from those of said dichroic layer (I) on the whole surface of the resulting structure by vapor deposition, (h) forming a metal layer (IV) on the whole surface of said dichroic layer (II) by vapor deposition, (i) dissolving said metal layer (III) with an etching solution to remove that layer together with the overlying dichroic layer (II) and metal layer (IV) deposited thereon, (j) forming a dichroic layer (III) having spectral characteristics different from those of said dichroic layers (I) and (II) on the whole surface of the resulting structure by vapor deposition, and (k) dissolving said metal layers (II) and (IV) with etching solution to remove those layers together with the dichroic layer (III) deposited thereon, the etching solution used for dissolving said metal layer (II) being different from that used for dissolving said metal layer (I), the etching solution used for dissolving said metal layer (III) being different from at least that used for dissolving the metal layer (II), and the etching solution used for dissolving said metal layer (IV) being different from at least that used for dissolving said metal layer (III).

3. A process for producing a parallel type of stripe filter which comprises the steps of:

(a) forming metal layers (I) and (II), in that order, on a transparent base plate, and forming a photoresist layer on the whole surface of said metal layer (II), and further subjecting the resulting structure to exposure, development and etching treatment to process said metal layer (II) ito predetermined parallel stripes, (b) forming a photoresist layer on the whole surface of the resulting structure, subjecting the structure having said photoresist layer to exposure, development and etching treatment to remove predetermined areas in a parallel stripe configuration, of said metal layer (I), thereby exposing the surface of said transparent base plate in a stripe configuration, and further removing the remaining photoresist layer, (c) forming a dichroic layer (i) having predetermined spectral characteristics on the whole surface of the resulting structure by vapor deposition, (d) forming a metal layer (III) on the whole surface of said dichroic layer (I) by vapor deposition, (e) dissolving said metal layer (II) with etching solution to remove that layer together with the overlying dichroic layer (I) and metal layer (III) deposited thereon, (f) dissolving the exposed areas of said metal layer (I) with etching solution, (g) forming a dichroic layer (II) having spectral characteristics different from that of said dichroic layer (I) on the whole surface of the resulting structure by vapor deposition, (h) forming a metal layer (IV) on the whole surface of said dichroic layer (II) by vapor deposition, (i) dissolving said metal layer (I) with etching solution to remove that layer together with the overlying dichroic layers (I) and (II), and metal layers (III) and (IV), (j) forming a dichroic layer (III) having spectral characteristics different from those of said dichroic layers (I) and (II) on the whole surface of the resulting structure by vapor deposition, and (k) dissolving said metal layers (III) and (IV) with etching solution to remove that layer together with the overlying dichroic layer (II) and dichroic layer (III) deposited thereon, said etching solution used for dissolving said metal layer (I) being different from that for said metal layer (II), said etching solution used for dissolving said metal layer (III) being different from that used for dissolving said metal layers (I) and (II), and said etching solution for said metal layer (IV) being different from at least that used for dissolving said metal layer (I).

* * * * *

UNITED STATES PATENT AND TRADEMARK OFFICE

CERTIFICATE OF CORRECTION

PATENT NO. : 4,182,647

DATED : January 8, 1980

INVENTOR(S) : SATOSHI YOSHIHARA, ET AL.

It is certified that error appears in the above-identified patent and that said Letters Patent are hereby corrected as shown below:

Col. 2, line 9, after "superimposed" insert --on--;

line 17, change "different three" to --three different--;

line 22, change "alternatively" to --alternately--.

Col. 3, line 16, change "natively" to --nately--;

line 41, change "bring" to --bringing--;

line 44, change "accuracy" to --accurately--.

Col. 5, line 2, change "aother" to --another--;

line 3, change "and" to --or--;

line 39, change "do" to --does--;

line 42, change "accuracy" to --precisely--;

line 45, change "Secondary" to --Secondly--.

Col. 6, line 42, delete "not"; and change "removed" to --retained--.

Col. 7, line 36, change "latter" to --last--;

line 45, change "the" (second occurrence) to --a--;

UNITED STATES PATENT AND TRADEMARK OFFICE

CERTIFICATE OF CORRECTION

PATENT NO. : 4,182,647

DATED : January 8, 1980

INVENTOR(S) : SATOSHI YOSHIHARA, ET AL.

It is certified that error appears in the above-identified patent and that said Letters Patent are hereby corrected as shown below:

Col. 7 (cont'd)

line 52, change "extreme" to --extremely--;

line 53, change "cate" to --cated--;

line 56, after "accuracy" insert --and by a simple process--;

line 57, change the " , " to -- . --; and delete "by a simple";

line 58, delete "process.".

Col. 8, line 16, delete "the" (second occurrence);

line 17, change "the" to --a--.

Signed and Sealed this

Tenth Day of March 1981

[SEAL]

Attest:

RENE D. TEGTMEYER

Attesting Officer

Acting Commissioner of Patents and Trademarks